US009376837B2

(12) United States Patent
Koelker

(10) Patent No.: US 9,376,837 B2
(45) Date of Patent: Jun. 28, 2016

(54) MULTISIDED KEY AND LOCK

(71) Applicant: Neil D. Koelker, Xenia, OH (US)

(72) Inventor: Neil D. Koelker, Xenia, OH (US)

( * ) Notice: Subject to any disclaimer, the term of this patent is extended or adjusted under 35 U.S.C. 154(b) by 21 days.

(21) Appl. No.: 14/538,034

(22) Filed: Nov. 11, 2014

(65) Prior Publication Data

US 2016/0130839 A1 May 12, 2016

(51) Int. Cl.
*E05B 27/00* (2006.01)
*E05B 19/00* (2006.01)

(52) U.S. Cl.
CPC ..... *E05B 27/0003* (2013.01); *E05B 19/0017* (2013.01)

(58) Field of Classification Search
CPC . E05B 19/00; E05B 19/0023; E05B 19/0035; E05B 27/0078; E05B 27/0082; E05B 27/086; E05B 29/00
USPC ..... 70/492, 491, 493, 402, 403, 407, 409
See application file for complete search history.

(56) References Cited

U.S. PATENT DOCUMENTS 913,942 A * 3/1909 Bodge ..... E05B 27/0017 70/358
1,020,208 A * 3/1912 Laughlin ..... E05B 27/00 70/403
2,093,925 A * 9/1937 Pickop ..... E05B 27/00 70/403
RE26,272 E * 9/1967 Schreiber ..... E05B 27/00 70/358
3,637,180 A * 1/1972 Parry ..... A47B 81/005 211/64
3,659,442 A * 5/1972 Cellini ..... E05B 35/00 292/19
4,058,992 A 11/1977 Nielsen, Jr.
4,069,695 A * 1/1978 Frank ..... E05B 27/086 29/445
4,193,277 A * 3/1980 Lo ..... E05B 21/06 70/358
4,211,096 A 7/1980 Lipschutz
4,729,231 A 3/1988 Wu
4,831,853 A 5/1989 Liao
4,934,164 A * 6/1990 Shew ..... E05B 27/0032 70/409
5,131,249 A * 7/1992 Baden ..... E05B 19/0029 70/398
5,247,818 A 9/1993 Lo
5,479,800 A * 1/1996 Myers ..... E05B 15/1635 70/365
5,493,884 A * 2/1996 Hinz ..... E05B 19/00 70/358

(Continued)

FOREIGN PATENT DOCUMENTS

WO 00/39421 7/2000

*Primary Examiner* — Suzanne Barrett
(74) *Attorney, Agent, or Firm* — Thomas E. Lees, LLC

(57) ABSTRACT

A system includes a multisided key with three or more sides, where all the sides of the multisided key are identical. Further, the system includes a cylindrical lock with inner and outer cylinders and a locking vane residing radially outward in a void spanning the inner and outer cylinders. The locking vane includes an inner portion including a first protrusion and a second protrusion corresponding to two levels of the multisided key and an outer portion separated from the inner portion by a gap, wherein at least a part of the outer portion is disposed in the outer void. When the multisided key is inserted into the lock, the gap of the locking vane aligns with an interface between the inner and outer cylinders, allowing the inner cylinder to rotate within the outer cylinder.

17 Claims, 7 Drawing Sheets

(56) References Cited

U.S. PATENT DOCUMENTS 6,910,356 B2 * 6/2005 Price ..... E05B 15/1614 70/358
7,353,675 B1 * 4/2008 Chao ..... E05B 27/0035 70/358
7,574,882 B2 8/2009 Uliano
7,694,542 B2 * 4/2010 Loughlin ..... E05B 19/00 70/329
9,234,370 B2 * 1/2016 Dolev ..... E05B 9/042
2006/0042335 A1 * 3/2006 Osada ..... E05B 19/0023 70/358
2009/0025442 A1 * 1/2009 Klein ..... E05B 19/0029 70/492
2009/0266123 A1 * 10/2009 Mueller ..... E05B 19/0029 70/348
2009/0293563 A1 12/2009 Jeng
2011/0041575 A1 * 2/2011 Habecke ..... E05B 19/0017 70/357
2014/0250959 A1 * 9/2014 Tsai ..... E05B 47/0044 70/491
2014/0298871 A1 * 10/2014 Shen ..... E05B 27/0075 70/493
2015/0300044 A1 * 10/2015 Malinen ..... E05B 21/066 70/353

* cited by examiner

MULTISIDED KEY AND LOCK

BACKGROUND

Various aspects of the present invention relate generally to mechanical locks, and specifically to cylindrical locks requiring a physical key to open.

A mechanical lock is a fastening device that releases when a certain condition is met. For example, a pin-tumbler lock includes pins with a gap in each of the pins at different levels and springs to radially push the pins such that the gaps are not aligned at an interface between an outer cylinder and an inner cylinder. When the proper key is inserted into a keyhole of the lock, the pins are raised to allow the individual gaps in the pins to be at the same level as the interface, which allows the inner cylinder of the lock to rotate, opening the lock.

A wafer-tumbler lock is similar to the pin-tumbler lock. However, the wafers include large gaps within the keyhole and springs that radially push the wafers such the bottom of the wafer extends into an outer cylinder from an inner cylinder. When the proper key is inserted into the keyhole, the key fits within the gaps and raises the wafers individually, which aligns the top and bottom of the wafer with the inner cylinder's edge and allows the inner cylinder to rotate within the outer cylinder, opening the lock.

A disc-tumbler lock utilizes a sidebar to prevent the lock from opening, and slotted retaining discs are used to determine the position of the sidebar. When the proper key is inserted into the keyhole, the key rotates the discs (similar to the tumblers of a safe) to align the slots of the discs, which allows the sidebar to drop into the slots, opening the lock. Unlike the pin-tumbler lock and the wafer-tumbler lock, the disc-tumbler lock does not include springs.

A tubular lock includes a set of pins similar to the pin-tumbler lock, except that the pins of the tubular lock are aligned parallel to the axis of the lock, as opposed to radially as in the pin-tumbler lock. When the proper key is inserted into the keyway, indentations on the tip of the key push the pins axially (not radially as with the pin-tumbler lock) to align with edges of a cylinder allowing the cylinder to rotate.

A key is a device used to operate a lock and typically includes a head (also referred to as the bow) and a shaft (also referred to as a blade). The shaft usually includes a set of levels and/or bumps that are coded to a specific lock as described above. The head allows a user grip the key to apply torque to rotate the inner cylinder of a lock within the outer cylinder when the proper key is inserted to the keyhole (also referred to as the keyway) of the lock.

BRIEF SUMMARY

According to aspects of the present disclosure, a multisided key includes a head and a shaft coupled to the head. The shaft includes a length and a tip at an end of the length opposite the head. Further, the shaft includes levels along the length such that each side of the multisided key is identical at each of the levels and transitions between the levels. For example, a cross section of any of the levels may be a regular polygon or a circle.

According to further aspects of the present disclosure, a lock corresponding to a multisided key includes an outer cylinder with an outer void and an inner cylinder including an inner void and a keyhole sized to allow the multisided key to enter the inner cylinder. The inner cylinder is disposed inside the outer cylinder and the outer cylinder and inner cylinder meet at an interface such that the inner cylinder can rotate inside the outer cylinder. A locking vane is disposed radially outward from a center of the inner cylinder. The locking vane includes an inner portion including a first protrusion and a second protrusion, wherein at least a part of the inner portion is disposed in the inner void and the first protrusion and the second protrusion correspond to two levels of the corresponding multisided key. Further, the locking vane includes an outer portion separated from the inner portion by a gap, wherein at least a part of the outer portion is disposed in the outer void. A spring coupled between the outer cylinder and the outer portion of the locking vane, wherein the spring pushes the locking vane such that the first protrusion resides in the keyhole when the corresponding multisided key is not in the keyhole.

According to still further aspects of the present disclosure, a system includes the lock and key described above.

BRIEF DESCRIPTION OF THE SEVERAL VIEWS OF THE DRAWINGS

The following figures illustrate various aspects of the present disclosure. The figures are not necessarily drawn to scale, and some of the spacing between elements has been exaggerated to illustrate aspects of the present disclosure. Further, similar reference numerals refer to similar elements throughout the figures.

DETAILED DESCRIPTION

Figure 1:
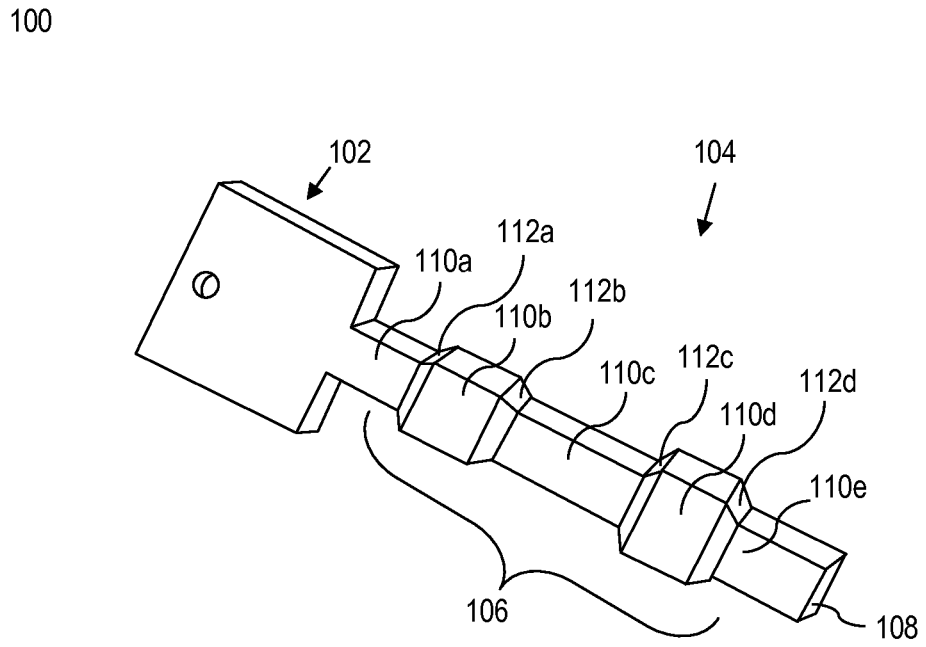
FIG. 1 is a perspective view of a multisided key, where the cross section of the multisided key is a square, according to various aspects of the present disclosure.

Referring to drawings, in particular to FIG. 1, a multisided key 100 is shown. The multisided key 100 includes a head 102 and a shaft 104, which includes a length 106. At an end of the length 106 of the shaft 104 opposite the head 102 is a tip 108, which may be inserted into a keyhole of a lock (e.g., locks of FIGS. 3-9 below). Different levels 110*a-e* run along the length 106 at different points along the shaft 104. As used herein, a level 110*a-e* on a shaft 104 is a portion of the length 106 of the shaft 104 that has a continuous and identical cross section.

As shown, transitions 112*a-d* between the levels 110*a-e* are sloped; however, the transitions 112*a-d* may take any form (e.g., abrupt, curved, etc.). As used herein, a transition 112*a-d* is a portion of the length 106 of the shaft 104, where the cross section is not continuous or not identical.

Figure 2:
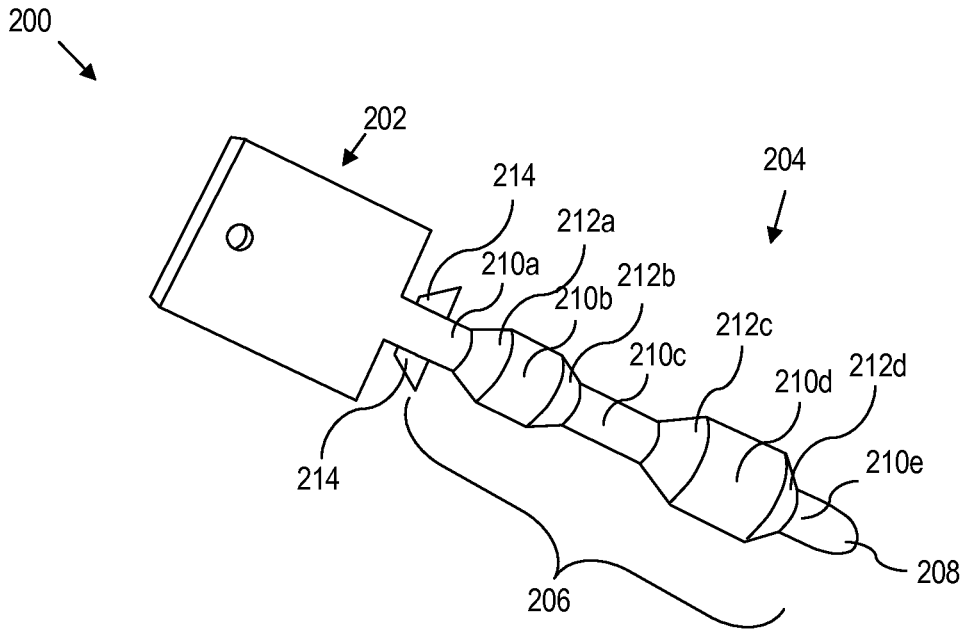
FIG. 2 is a perspective view of a multisided key, where the cross section of the multisided key is a circle, according to various aspects of the present disclosure.

A cross section at any level 110*a-e* (i.e., non-transition) along the length 106 should be a regular-polygon shape or a circular shape. For example, as shown in FIG. 1, a cross section taken at any point along the length 106 is a square (i.e., a regular quadrilateral). However, the cross section may be an equilateral triangle (i.e., a regular triangle), a regular pentagon, a regular hexagon, etc. The number of sides of the regular polygon may be infinite, which would result in a circular shape (as shown in FIG. 2). Thus, the number of sides of the multisided key 100 may range from three sides (triangular cross section) to an infinite number of sides (circular cross section).

Further, the cross section does not need to be the same at every point along the length 106. Note that the transitions 112*a-d* between the levels 110*a-e* are not required to be a regular polygon or circular (e.g., the cross section of a sloped transition from a triangular cross section to a square cross section may be trapezoidal).

Moreover, there may be any number of levels 110*a-e* along the length 106. For example, as shown in FIG. 1, there are five levels 110*a-e*; however, there may be less than five or more than five levels. Still further, each level 110*a-e* is not required to have its own unique cross section. For example, the cross section of the third level 110*c* is identical to the cross section of the fifth level 110*e* in FIG. 1, even though there are two transitions 112*c-d* and one level 110*d* between the two. Thus, the number of unique cross sections of all the levels combined should be less than or equal to the number of levels 110*a-e*.

Also, as shown in FIG. 1, the tip 108 is blunt. However, the tip 108 may be angled, rounded, etc. Further, the tip 108 is not required to have any specific cross section related to the levels 110*a-e* or transitions 112*a-d*.

Turning now to FIG. 2, a multisided key 200 with circular cross sections is shown. As with the multisided key 100 of FIG. 1, the multisided key 200 of FIG. 2 has a head 202 and a shaft 204 with a length 206 and a tip 208. Further, the length 206 includes levels 210*a-e* and transitions 212*a-d*, similar to the levels 110*a-e* and transitions 112*a-d* of FIG. 1.

However, the multisided key 200 of FIG. 2 further includes engagement fins 214 that apply torque to an inner cylinder of a lock when a user applies torque to the head 202 (the manner in which the torque is applied to the inner cylinder is discussed in further detail below in reference to FIGS. 3, 6, and 8). As shown, the engagement fins 214 are planar splines located on the shaft 204 near the head 202 of the multisided key 200.

However, the engagement fins 214 may take any desirable shape or location. For example, the engagement fins 214 may be a post-shaped spline protruding from the head. As another example, a tip 208 shaped similar to a flathead screwdriver as an engagement fin 214. A further example of engagement fins 214 includes using the head 202 as the engagement fins 214, as shown in reference to FIG. 8 below.

Multisided keys that do not have at least one level with a low number of sides should include some sort of engagement fin 214. However, multisided keys with at least one level with a low number of sides do not necessarily need engagement fins 214, but may include one or more engagement fins if desired.

The multisided keys discussed above can be inserted into a keyhole in a number of ways equal to the number of sides of a certain level. For example, a multisided key with all square cross sections at the levels can be inserted into a corresponding keyhole in any of four ways, and a multisided key with all circular sections at the levels can be inserted into a corresponding keyhole in any way. Thus, a user is not required to align the multisided key as carefully as a conventional key, which makes it easier to unlock a lock when there is low light, when the user is distracted, when the user is carrying other items, etc.

Figure 3:
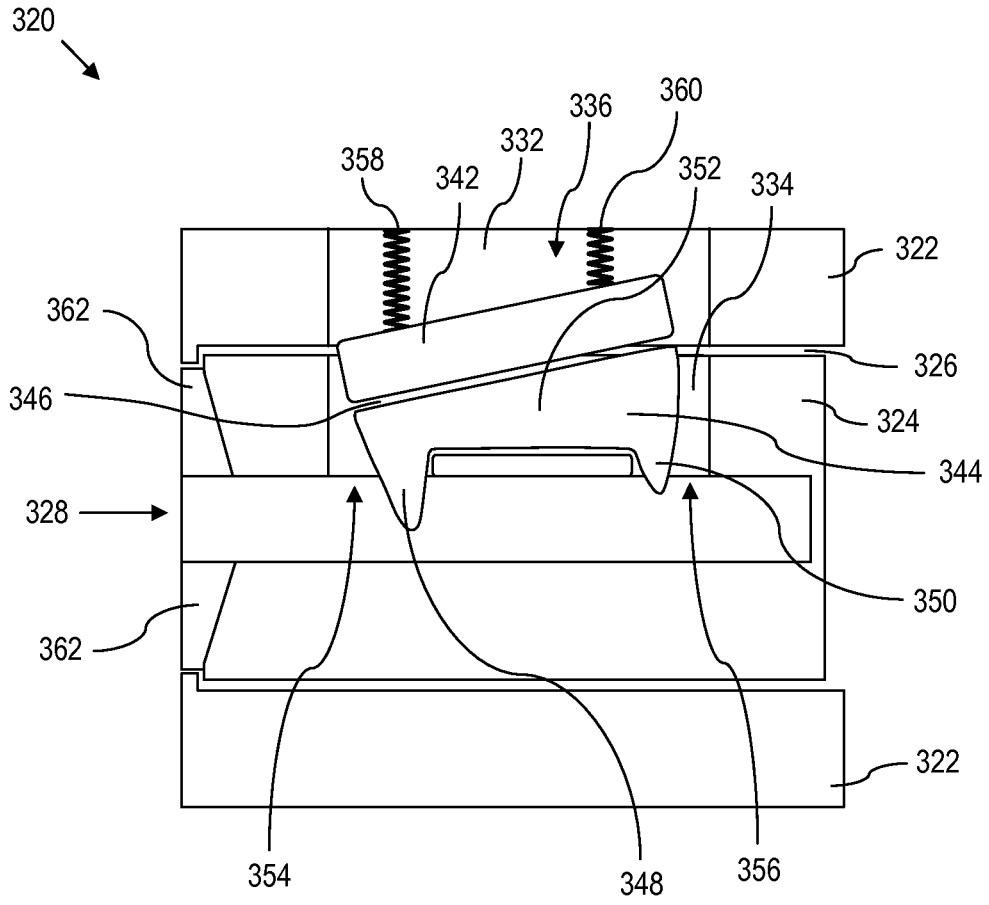
FIG. 3 is a cutout side view of a lock for a multisided key, according to various aspects of the present disclosure.

Turning now to FIG. 3, a cutaway of a lock 320 to be used with a multisided key (e.g., 100, 200 above) is shown. The lock 320 includes an outer cylinder 322 and an inner cylinder 324 coaxially disposed within the outer cylinder 322 creating an interface 326 between the outer cylinder 322 and the inner cylinder 324. The inner cylinder 324 includes a keyhole (also referred to as a keyway) 328 sized to allow a corresponding multisided key to enter the inner cylinder 324. For example, the keyhole should be generally the same size in area as the cross section of the largest level (i.e., the level with the largest cross-sectional area) on the corresponding multisided key.

The outer cylinder 322 further includes an outer void 332, and the inner cylinder 324 further includes an inner void 334. When the lock 320 is in a locked position, the outer void 332 and the inner void 334 are aligned. A locking vane 336 comprising an outer portion 342 and an inner portion 344 is disposed radially outward from the axis of the inner cylinder within the outer void 332 and inner void 334. The outer portion 342 of the locking vane 336 and the inner portion 344 are separated by a gap 346. When the lock 320 is in the locked position and the corresponding key is not placed within the keyhole 328, the gap 346 is not aligned with the interface 326 such that at least a portion of the outer portion 342 of the locking vane 336 resides within the outer void 332. Thus, the locking vane 336 prevents the inner cylinder 324 from rotating within the outer cylinder 322.

The inner portion 344 of the locking vane 336 includes a first protrusion 348, which corresponds to a level on the corresponding multisided key, and a second protrusion 350, which corresponds to another level on the corresponding multisided key, coupled by a bridge 352. When the bridge 352 is resting on the inner cylinder 324, the first and second protrusions 348, 350 extend (at least partially) through a first hole 354 and a second hole 356 respectively of the inner cylinder 324. To ensure that the bridge 352 rests on the inner cylinder 324, a first spring 358 and a second spring 360 coupled between the outer cylinder 322 and the outer portion 342 of the locking vane 336 push the locking vane 336 against the inner cylinder 324. As shown, there are two springs 358, 360; however, any number of springs (e.g., one, three, four, etc.) may be used. Further, as shown, the first protrusion 348 is closer to the keyhole; however, the first protrusion 348 may be further from the keyhole than the second protrusion 350.

Further, as shown, the protrusions 348, 350 are roughly triangular in shape; however, any suitable shape may be used (e.g., partial circle, partial oval, rounded quadrilateral, partial sphere, column, etc.). Further, the protrusions 348, 350 may be ball bearings that allow the multisided key to slide along the protrusions 348, 350 when the multisided key is inserted into the keyhole 328. Moreover, the first protrusion 348 may be different than the second protrusion 350. For example, the first protrusion 348 may be a ball bearing and the second protrusion 350 may be a partial circle.

As shown, the lock 320 includes one locking vane 336. However, there may be as many or more locking vanes 336 inside the lock 320 as there are sides to the corresponding multisided key. Further, the protrusions 348, 350 of the locking vanes 336 do not need to correspond to the same level of the multisided key. For example, if a lock has three locking vanes and the corresponding multisided key has five levels, the first locking vane could correspond to levels two and five, the second locking vane could correspond to levels one and four, and the third locking vane could correspond to levels three and five. Moreover the locking vanes can be staggered along the length of the lock if desired.

If there is more than one locking vane, if the lengths of the voids for the locking vanes are the similar for all three locking vanes, and if the locking vanes are not staggered, then the key can be removed without returning the inner cylinder to its original position. For example, if the lock 320 includes three locking vanes 336 (same length and not staggered) spaced one-hundred-twenty degrees apart, then the user just needs to rotate the inner cylinder 324 one-hundred-twenty degrees (in either direction) before the key can be removed without returning the inner cylinder 324 to its original position as is required in a conventional lock.

Further, the lock 320 of FIG. 3 includes engagement slots 362*a-b* that accept the engagement fins to allow a user to provide torque to the inner cylinder 324. Locks that correspond to multisided keys without locking fins (as described above in reference to FIG. 2) do not require the engagement slots 362*a-b*.

Figure 4:
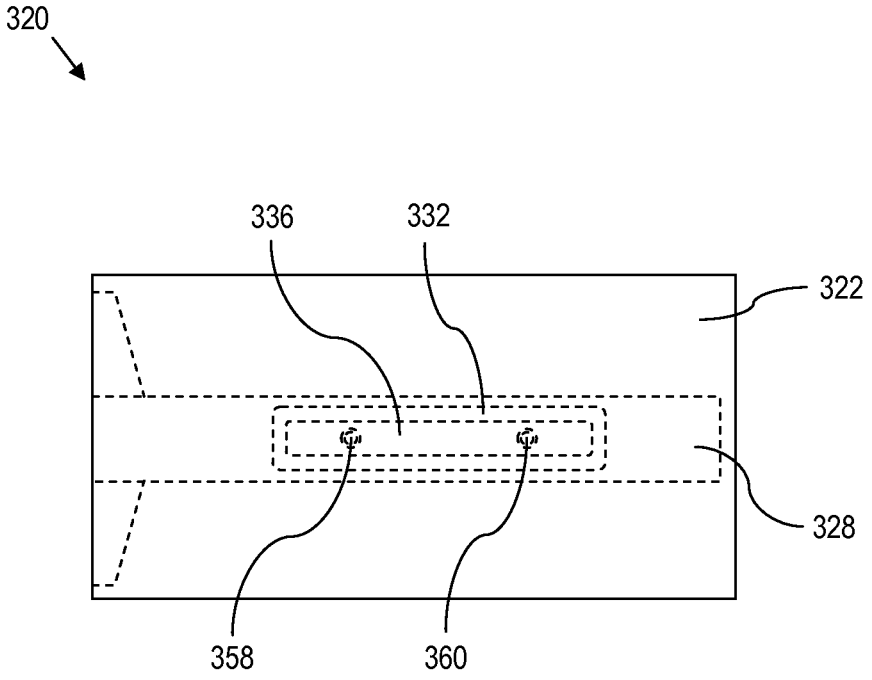
FIG. 4 is a top view of a lock for a multisided key, where a void and a locking vane are parallel to an axis of an outer cylinder, according to various aspects of the present disclosure.

FIG. 4 illustrates a top view of the cylindrical lock 320 of FIG. 3 to illustrate various aspects of the present disclosure. As mentioned in the description of FIG. 3, the lock 320 includes a keyhole 328, an outer void 332, a locking vane 336, and two springs 358, 360. As mentioned above, the outer void 332 (and thus the locking vane 336) is disposed radially outward from the center of the cylindrical lock 320. Further, in FIG. 4, the outer void 332 and locking vane 336 also runs parallel to the axis of the cylinder (i.e., lengthwise).

Figure 5:
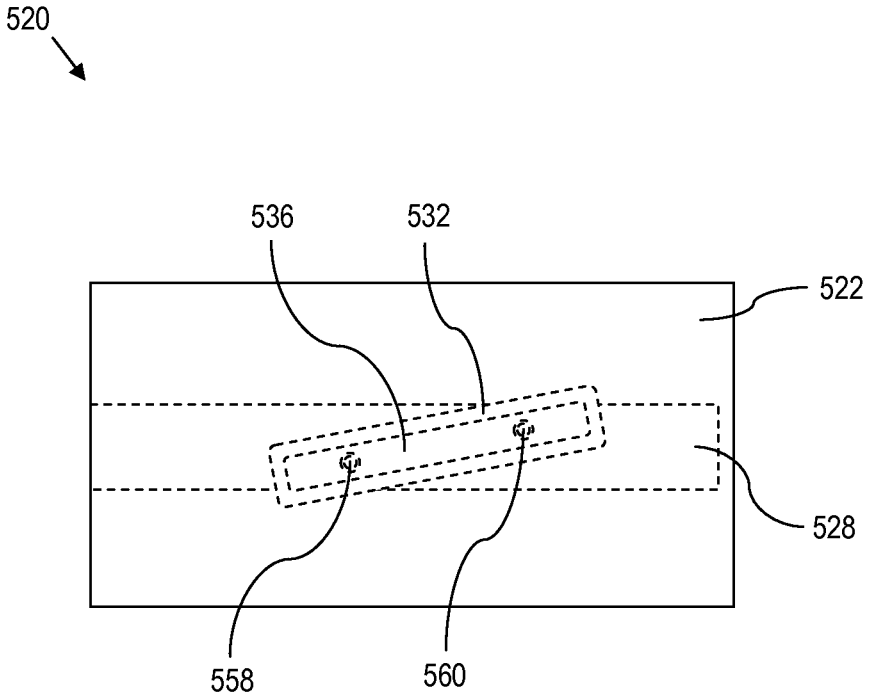
FIG. 5 is a top view of a lock for a multisided key, where a void and a locking vane are skewed from an axis of an outer cylinder, according to various aspects of the present disclosure.

FIG. 5, on the other hand, illustrates an alternate embodiment of the lock of FIG. 3. As with the lock 320 of FIGS. 3-4, the lock 520 includes a keyhole 528, an outer void 532, a locking vane 536, and two springs 558, 560. Also, the outer void 532 (and thus the locking vane 536) is disposed radially outward from the center of the cylindrical lock 520 (similar to the lock 320 of FIG. 3). However, instead of being parallel to the axis the length of the lock 520, the outer void 532 (along with the inner void (not shown in FIG. 5) and the locking vane 536) is skewed relative to the axis of the lock (and thus skewed relative to the axis of the outer cylinder and inner cylinder).

Other embodiments for the orientation of the outer void 332, 532 exist. For example, the outer void may be X-shaped, and the locking vane may also be X-shaped such that the locking vane has four protrusions.

Figure 6:
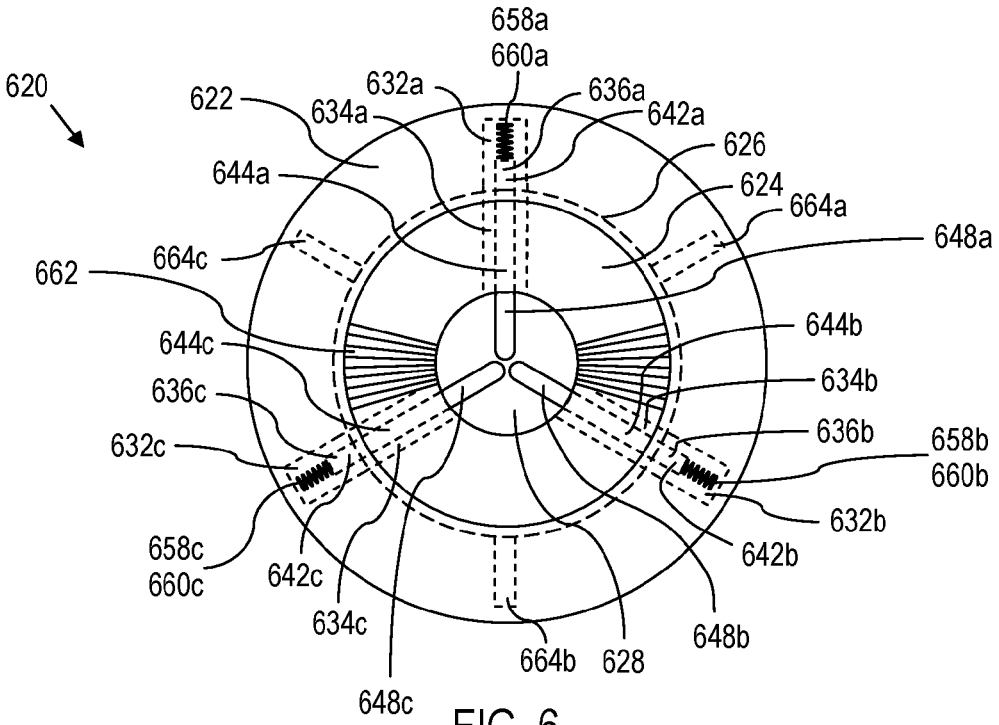
FIG. 6 is a front view of a lock for a multisided key, according to various aspects of the present disclosure.

FIG. 6 is a front view of a lock 620 similar to the lock of FIGS. 3-4. The lock 620 has an outer cylinder 622 meeting an inner cylinder 624 at an interface 626. A keyhole 628 allows a user to insert a corresponding multisided key. The outer cylinder 622 includes three outer voids 632*a-c*, and the inner cylinder 624 includes three inner voids 634*a-c*. Within each of the three voids is a locking vane 636*a-c* each comprising an outer locking vane 642*a-c* and an inner locking vane 644*a-c*. At least one protrusion 648*a-c* of the locking vanes 636*a-c* are at least partially within the keyhole 628. Springs 658*a-c*, 660*a-c* push the locking vanes 636*a-c* toward the axis of the lock 620. Each of the elements described above in reference to FIG. 6 perform similar functions of their counterparts in FIG. 3.

The lock 620 of FIG. 6 includes eight engagement slots 662 on the inner cylinder 624. More engagement slots 662 in the inner cylinder 624 increases the chance that a user will enter the corresponding key in the right orientation to engage the engagement fins into one of the engagement slots 662. As such, any number of engagement slots may be used.

Further, the lock 620 includes three open outer voids 664*a-c* spaced between the outer voids 632*a-c*. These open outer voids 664*a-c* are similar to the outer voids 632*a-c* except the open outer voids 664*a-c* do not include an outer portion of a locking vane or springs. When a user rotates the inner cylinder 624 sixty degrees in either direction, the inner voids 634 align with the open outer voids 664, and the user may remove the multisided key without placing the lock 620 in a locked position.

A mechanism (not shown) such as a bolt or other impediment may be coupled to the inner cylinder 624 such that the mechanism is retracted when the inner cylinder 624 is rotated at sixty, one-hundred-eighty, and three-hundred degrees, while the mechanism is extended at zero, one-hundred-twenty, and two-hundred-forty degrees. For example, the mechanism may be attached to the inner cylinder 624 similar to a piston. This type of configuration is suited for a door lock.

Other locking mechanisms may be used with the locks described herein. For example, a spring may force the outer cylinder coupled to the locking mechanism to rotate when the corresponding multisided key engages the locking vanes correctly. This configuration is suited for a padlock.

Figure 7:
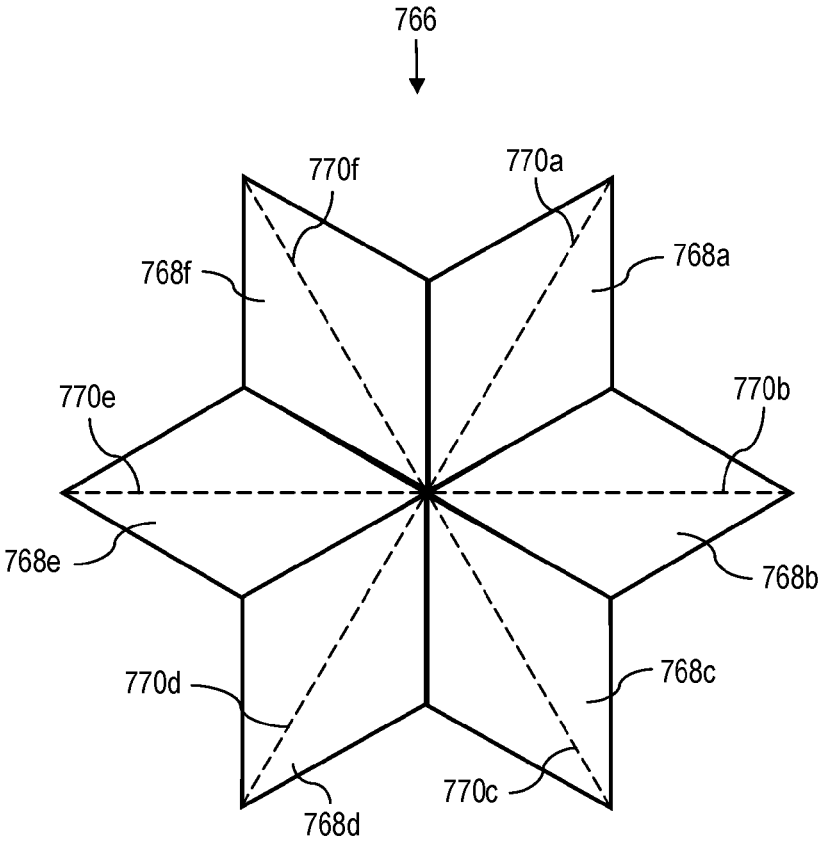
FIG. 7 is a front view of a lock for a multisided key, where the lock includes a cover, according to various aspects of the present disclosure.

FIG. 7 is a front view of a lock with a cover 766. The cover 766 of FIG. 7 includes six biconical pieces (a bicone is a 3-dimensional geometrical shape where two cones share an axis and are joined at the base) 768*a-f* converging at a single point near the axis of the cylindrical lock. The circumferences of the bases of the biconical pieces 768*a-f* are designated by dotted lines 770*a-f*. An annular spring (not shown) forces the biconical pieces 768*a-f* to converge on the axis of the lock. Alternatively, each of the pieces 768*a-f* may have its own spring forcing the piece toward the axis of the lock. However, when a user pushes a multisided key at the axis of the lock, the key will engage the circumferences 770*a-f* of the biconical pieces 768*a-f* to force the biconical pieces 768*a-f* to expand outward (e.g., roll back), exposing the keyhole, which the multisided key may enter. When the multisided key is removed, the annular spring forces the biconical pieces 768*a-f* back to the center position. While six biconical pieces are shown, any number of biconical pieces may be used for the cover 766.

Also, the cover may have other embodiments. For example, instead of bicones, the cover may comprise biconical frusta. In another embodiment of the cover, the cover pieces may not have a circumference, but instead be flat on the side facing the lock and sloped radially inward on the side facing the user, such that when a user pushes a multisided key at the axis of the lock, the cover pieces may slide away from the axis of the lock. Other covers may be used on the locks described herein.

The multi-piece covers described above (e.g., bicones, biconical frusta, sliding pieces, etc.) protect the lock from the elements (e.g., rain, snow, etc.). Further, the multi-piece covers help prevent someone from picking the lock because the pieces must be moved and kept away from the keyhole (the annular spring forces the pieces back to the keyhole, as discussed above) to allow access for lock-picking tools.

Figure 8:
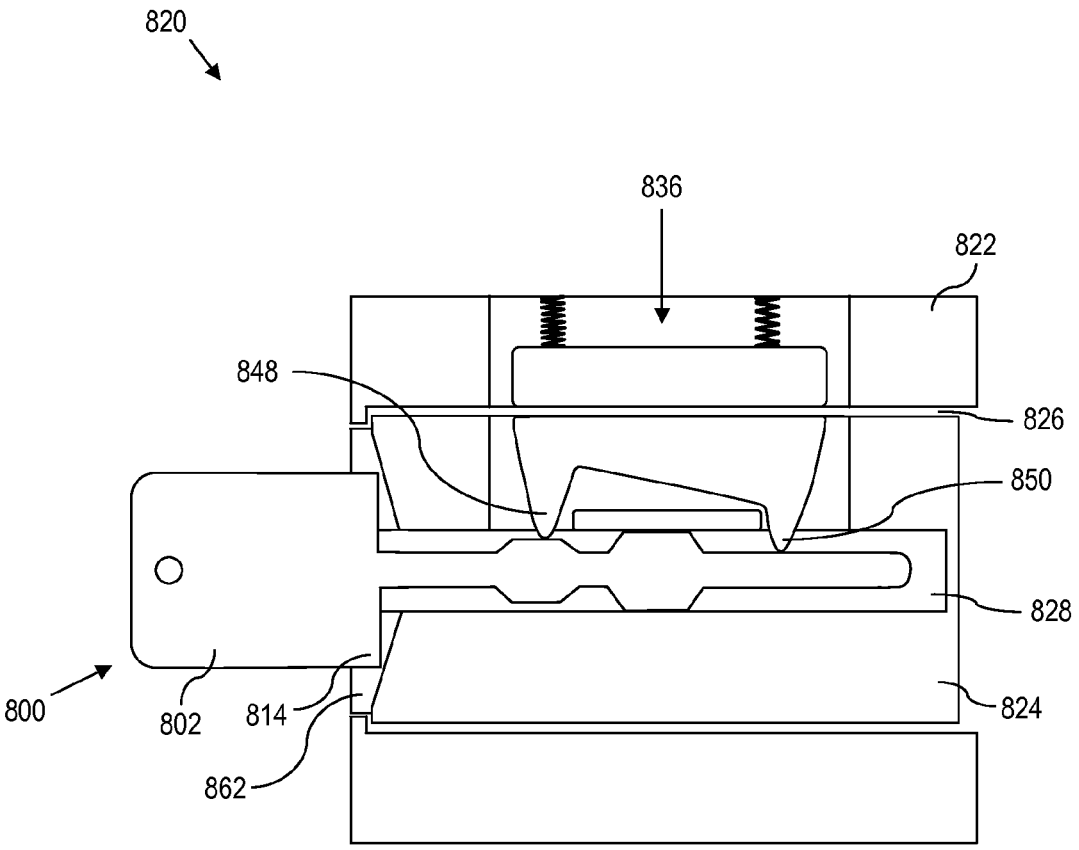
FIG. 8 is a cutout side view of a lock for a multisided key with a corresponding multisided key inserted into a keyway, according to various aspects of the present disclosure.

FIG. 8 illustrates a multisided key 800 inserted into a keyhole 828 of a corresponding lock 820. The lock 820 is similar to the lock 320 of FIG. 3, so will not be described again here. The protrusions 848, 850 of the locking vane 836 are manipulated by the levels 810 of the key 800, and the locking vane 836 rises and levels out. The gap 846 of the locking vane 836 aligns with the interface 826 between the outer cylinder 822 and the inner cylinder 824. As such, when a user applies torque to the inner cylinder 824, the inner cylinder 824 is free to rotate. As shown, the key 800 uses the head 802 as engagement fins 814 to apply torque to the inner cylinder 824 via the engagement slots 862.

Figure 9:
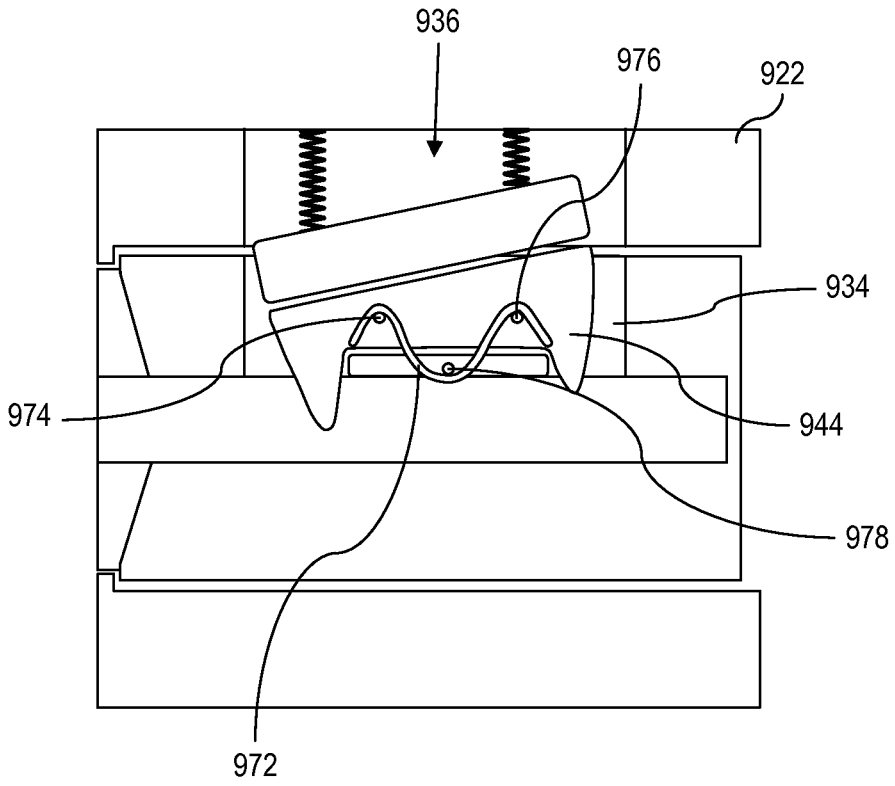
FIG. 9 is a side view of a locking vane with a retention spring, according to various aspects of the present disclosure.

FIG. 9 illustrates an embodiment of the locking vanes described herein. The locking vane 936 of FIG. 9 further includes a retention spring 972 coupled between two small posts 974, 976 of the inner locking vane 944 and a bar 978 of the inner cylinder 924. The retention spring 972 pulls the inner locking vane 944 toward the axis of the lock. Thus, the inner locking vane 944 will not slide out of the inner void 934 when the lock is in an unlocked position and gravity pulls the inner locking vane 944 toward an open outer void. Further, in embodiments with the spring to rotate the outer cylinder 922, the retention spring 972 keeps the inner locking vane 944 from blocking the rotation of the outer cylinder 922 when the outer cylinder 922 is being reset.

Any of the features, elements, and embodiments described herein may be matched with other features, elements, and embodiments described herein to create different multisided keys, locks, and systems. For example, a system could use a multisided key with four levels, sloped transitions, circular cross sections, a rounded tip, and use the head of the key as engagement fins. A lock of the example system could have a round keyhole, three locking vanes each with retention springs and partial circular protrusions, three open outer voids, and a cover with biconical pieces, where the locking vanes are skewed axially. Other combinations of the features, elements, and embodiments exist.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Aspects of the invention were chosen and described in order to best explain the principles of the invention and the practical application, and to enable others of ordinary skill in the art to understand the invention for various embodiments with various modifications as are suited to the particular use contemplated.

What is claimed is:

1. A system comprising:
- a multisided key including:
  - a head; and
  - a shaft coupled to the head, the shaft including:
    - a length;
    - a tip at an end of the length opposite the head;
    - levels along the length such that each side of the multisided key is identical at each of the levels; and
    - transitions between the levels;
- a lock comprising:
  - an outer cylinder including an outer void;
  - an inner cylinder including an inner void and a keyhole sized to allow the multisided key to enter the inner cylinder, wherein the inner cylinder is disposed inside the outer cylinder and the outer cylinder and inner cylinder meet at an interface;
  - a locking vane disposed radially outward from a center of the inner cylinder, the locking vane including:
    - an inner portion including a first protrusion and a second protrusion, wherein at least a part of the inner portion is disposed in the inner void and the first protrusion and the second protrusion correspond to two levels of the multisided key; and
    - an outer portion separated from the inner portion by a gap, wherein at least a part of the outer portion is disposed in the outer void; and
  - a spring coupled between the outer cylinder and the outer portion of the locking vane, wherein the spring pushes the locking vane such that the first protrusion resides in the keyhole when the multisided key is not in the keyhole.

2. The system of claim 1, wherein the cross section of the shaft at any point along the length of the shaft is a regular-polygon shape.

3. The system of claim 1, wherein the cross section of the shaft at any point along the length of the shaft is a circle.

4. The system of claim 3, wherein:
- the multisided key further includes engagement fins; and
- the inner cylinder further includes engagement slots;
- wherein the engagement fins fit into the engagement slots to allow the multisided key to rotate the inner cylinder within the outer cylinder.

5. The system of claim 1, wherein:
- the lock further includes bicones coupled to at least one spring such that the bicones are forced to cover the keyhole; and
- the tip of the key forces the bicones radially away from the keyhole so the multisided key may enter the keyhole.

6. The system of claim 1, wherein:
- the first protrusion is a first bearing to allow the multisided key to slide along the first protrusion; and
- the second protrusion is a second bearing to allow the multisided key to slide along the second protrusion.

7. The system of claim 1, wherein the outer cylinder includes a second outer void, which allows the multisided key to be removed from the keyhole while the lock is in an unlocked position.

8. The system of claim 1, wherein:
- the outer cylinder further includes a second outer void;
- the inner cylinder further includes a second inner void; and
- the lock further includes a second locking vane disposed radially outward from a center of the inner cylinder, the second locking vane including:
  - an inner portion including a first protrusion and a second protrusion, wherein at least a part of the inner portion is disposed in the second inner void and the first protrusion and the second protrusion correspond to two levels of the multisided key; and
  - an outer portion separated from the inner portion by a gap, wherein at least a part of the outer portion is disposed in the second outer void.

9. The system of claim 1, wherein the lock further includes an outer-cylinder spring that forces the outer cylinder to rotate when the multisided key engages the first and second protrusions.

10. A lock comprising:
- an outer cylinder including an outer void;
- an inner cylinder including an inner void and a keyhole sized to allow the multisided key to enter the inner cylinder, wherein the inner cylinder is disposed inside the outer cylinder and the outer cylinder and inner cylinder meet at an interface;

a locking vane disposed radially outward from a center of the inner cylinder, the locking vane including:

an inner portion including a first protrusion and a second protrusion, wherein at least a part of the inner portion is disposed in the inner void and the first protrusion and the second protrusion correspond to a corresponding multisided key; and an outer portion separated from the inner portion by a gap, wherein at least a part of the outer portion is disposed in the outer void; and a spring coupled between the outer cylinder and the outer portion of the locking vane, wherein the spring pushes the locking vane such that the first protrusion resides in the keyhole when the multisided key is not in the keyhole.

11. The lock of claim 10 further including a cover coupled to at least one spring such that the cover is forced to cover the keyhole.

12. The lock of claim 10, wherein:

the first protrusion is a first bearing to allow the corresponding multisided key to slide along the first protrusion; and the second protrusion is a second bearing to allow the corresponding multisided key to slide along the second protrusion.

13. The lock of claim 10, wherein the outer cylinder includes a second outer void, which allows the corresponding multisided key to be removed from the keyhole while the lock is in an unlocked position.

14. The lock of claim 10, wherein:

the outer cylinder further includes a second outer void; and the inner cylinder further includes a second inner void;

further including a second locking vane disposed radially outward from a center of the inner cylinder, the second locking vane including:

an inner portion including a first protrusion and a second protrusion, wherein at least a part of the inner portion is disposed in the second inner void and the first protrusion and the second protrusion correspond to two levels of the corresponding multisided key; and an outer portion separated from the inner portion by a gap, wherein at least a part of the outer portion is disposed in the second outer void.

15. The lock of claim 10 further including an outer-cylinder spring that forces the outer cylinder to rotate when the multisided key engages the first and second protrusions.

16. The lock of claim 10, wherein a length of the first void is skewed relative to the axis of the outer cylinder.

17. The lock of claim 10, wherein the inner portion of the locking vane is pulled radially inward via a retention spring coupled between the inner cylinder and the inner portion of the locking vane.

* * * * *